US005303522A

United States Patent [19]

Vagedes

[11] Patent Number: 5,303,522

[45] Date of Patent: Apr. 19, 1994

[54] INTERNALLY FLASHED SIDING CHANNEL

[76] Inventor: Michael Vagedes, 677 Sunnybrook Dr., Florence, Ky. 41042

[21] Appl. No.: 65,623

[22] Filed: May 21, 1993

[51] Int. Cl.[5] ..... E06B 7/14

[52] U.S. Cl. ..... 52/97; 52/209

[58] Field of Search ..... 52/97, 209, 302.3, 302.6

[56] References Cited

U.S. PATENT DOCUMENTS

| | | | |
|---|---|---|---|
| 1,736,237 | 11/1929 | Whitaker | 52/97 X |
| 2,635,720 | 4/1953 | Kolkey et al. | 52/97 |
| 2,755,894 | 7/1956 | Weyl et al. | 52/97 |
| 3,690,079 | 9/1972 | Hemminger | 52/97 |
| 5,109,641 | 5/1992 | Halan | 52/97 X |

*Primary Examiner*—Carl D. Friedman

*Assistant Examiner*—Kevin D. Wilkens

[57] ABSTRACT

A channel for lapped siding includes an elongated nailing strip and an abutment strip with an upper cover strip. This provides a generally C-shaped cross-section. Inside the channel is a rectangular tab that extends at an angle away from the nailing strip up to the cover strip. The channel is nailed to a building. Lapped siding is also nailed to the building with edges of the siding positioned in the channel. The edge of the siding is slit horizontally to allow the tab to intersect the edge of the siding. Any water that gets into the channel will run along this tab away from the building wall to an exterior surface of the siding. This keeps the water from flowing behind the siding.

13 Claims, 1 Drawing Sheet

INTERNALLY FLASHED SIDING CHANNEL

BACKGROUND OF THE INVENTION

Lap siding is installed on a building by nailing the siding to the exterior surface of the building wall. Particularly with vinyl and aluminum siding, channels are used to cover the ends of the siding. Thus, when siding abuts a door frame, window frame, building corner, or edge of a vent, a channel is provided to cover the cut end of the siding. The channel can be a separate article or can mold into an article.

These channels have a C-shaped cross-section formed from three elongated narrow strips, a nailing strip, an abutment strip which extends up from the nailing strip and then a covering strip which extends parallel to the nailing strip. The siding is nailed to the exterior of the building with the cut ends extending into these channels. The purpose of this is to provide some play in the sizing of the pieces of siding. This reduces the required accuracy. If the siding is cut half inch too short, the channel will cover this and the final product has a very professional, finished appearance.

Unfortunately, water can flow from upper horizontal portions of a channel into the vertical channel. Once in the vertical channel, the water can run down the channel and back behind the siding. This, of course, causes moisture damage to the wall of the building and can even damage the interior of the building. Further, if enough water accumulates behind the siding and freezes, it will cause the siding to separate from the building.

SUMMARY OF THE INVENTION

It is an object of the present invention to provide a siding channel which eliminates the damage caused by water flowing down the channel. Further, it is an object of the present invention to provide such a channel which directs water flowing down the channel away from the house so that the water cannot accumulate behind the siding.

The objects and advantages of the present invention are provided by a C-shaped siding channel which includes a nail strip, an abutment strip, and a cover strip wherein a tab or web extends from the nail strip, along the abutment strip, to the cover strip providing internal flashing for the channel. Thus, water flowing down the channel will flow along the tabs away from the house. The siding is installed with the edges of the siding coming as close as possible to the abutment edge. Where the siding edge intersects a tab, a small horizontal slit is cut in the siding. The siding is simply slipped over the tab so that the tab extends along the slit in the edge of the siding.

Accordingly, when water flows down the channel, it will contact the tab, flow away from the building out to the exterior side of the siding, and down the side of where it will run to the ground. This will keep the water for accumulating from behind the siding and causing damage to the house and the siding.

The objects and advantages of the present invention will be further appreciated in light of the following detailed description and drawings in which:

DETAILED DESCRIPTION

Figure 1:
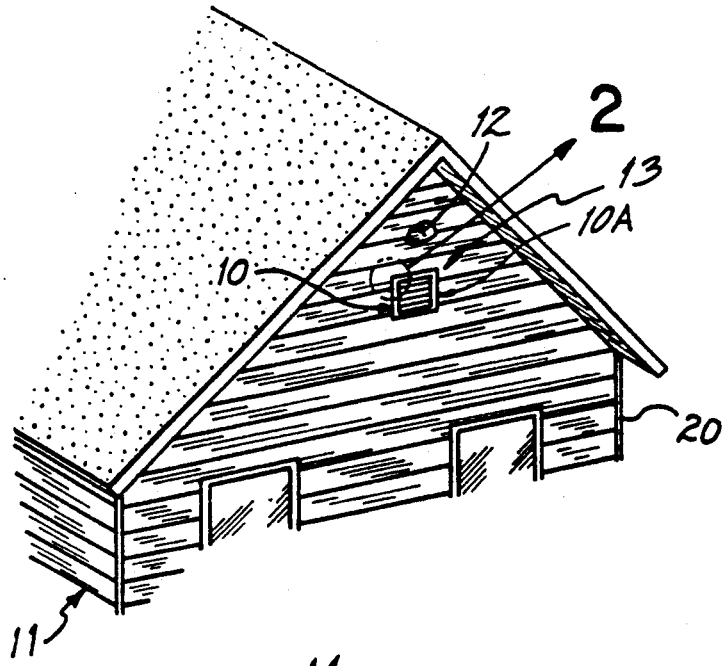
FIG. 1 is a perspective view of a house incorporating siding channels of the present invention.

The present invention is a siding channel 10 which is nailed to an outer wall surface 12 of a house 11. As shown in the FIG. 1, channel 10 surrounds and is part of an eave vent 13. In eave vent 13, the phantom-lined area 19 designates the slats of the vent. However, the channel can also be present around a door, window or can be a corner channel, a channel surrounding a mounting fixture for a light, a close dryer vent opening, a basement vent opening, and the like. In these embodiments, the phantom-lined area would, for example, designate a portion of the mounting fixture, vent or would be open in the case of a door frame. In all of these embodiments, the channel is the same. It is simply part of a different building product. Or in the case of the door frame or corner strip, the channel is the complete product.

Channel 10 is a left vertical channel which runs down from a horizontal channel 14. There is also a right channel 10A which is a mirror image of channel 10 and only channel 10 is described.

Figure 2:
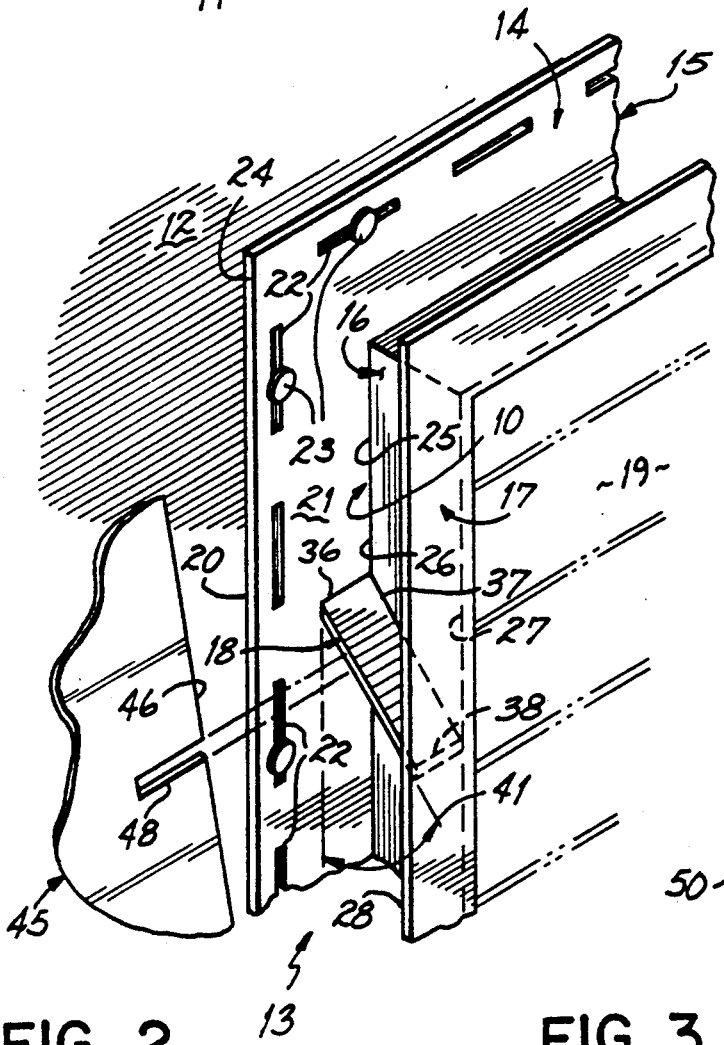
FIG. 2 is an enlarged portion of FIG. 1 taken at encircled area 2.

As shown in FIG. 2, the channel 10 includes a nail strip 15 with a siding abutment strip 16 extending away from the nail strip and a cover strip 17 which extends from the abutment strip 16 parallel to the nail strip 15. There are one or more tabs 18 which extend from the nail strip 15 along the abutment strip 16 to the cover strip 17. These tabs are present only on vertical channels.

As shown more particularly in FIG. 2, the nail strip which is about 1.5 inches wide, includes a base side 20 which faces or contacts the building wall 12 and an outer side 21 facing away from the building. Likewise, there are a plurality of nail holes or slots 22 extending through this nail strip 15 adapted to receive the shanks of nails 23. Nail strip 15 likewise includes first edge 24 which faces the siding and a second edge 25. The abutment strip 16 typically extends about 0.75 inches at about a 90° angle out from the second edge 25 of the nail strip 15. It includes an inside surface 26, again being the side that faces the siding. The cover strip 17 then extends about 0.75 inches away from the abutment strip 16 at the upper edge 27 of the abutment strip 16.

Channel 10 includes one or more of tabs 18. Each tab includes a first edge 36 which is bonded to the outer surface 21 of nail strip 15. The adjacent second edge 37 of tab 18 extends along the inside surface 26 of abutment strip 16. The third edge 38 of tab 18 is opposite the first edge and is bonded to the inside surface 28 of cover strip 17. As shown, cover strip 17 is about 0.25 inches wider than tab 18.

As shown in FIG. 2, the tab extends at an angle 41 down and away from the nail strip 15. This angle should be from 20° to 70° and preferably is about 45°. Obviously it must be less than 90°. The channel when installed is generally part of a vent, window, or other fixture. The tab will be located on a vertical channel near a horizontal channel. For a rectangular channel surrounding a vent, a tab is located within two inches of a corner. For an octagonal vent, the tab is located on vertical sides. For a door frame, a tab is located near the corners on the vertical channels. Additional channels can be located along the vertical channels.

To install the channel of the present invention and siding associated with the channel, the channel 10 is first nailed to the wall 12 with nails extending through the holes 22 in the nail strip 15. The siding 45 is then cut to size so that the inside edge 46 nearly abuts abutment strip 16. Thus, the edge 46 will be covered by the cover strip 17. Where the edge 46 would contact tab 18, a small horizontal slit 48 is cut through the edge 46 to permit the tab to extend or intersect through the edge 46 into the siding. Since cover strip 17 is wider than tab 18, it should conceal slit 48. After installation of the siding, water will flow down the channel 10, along tab 18, and to the outer side of siding.

Figure 3:
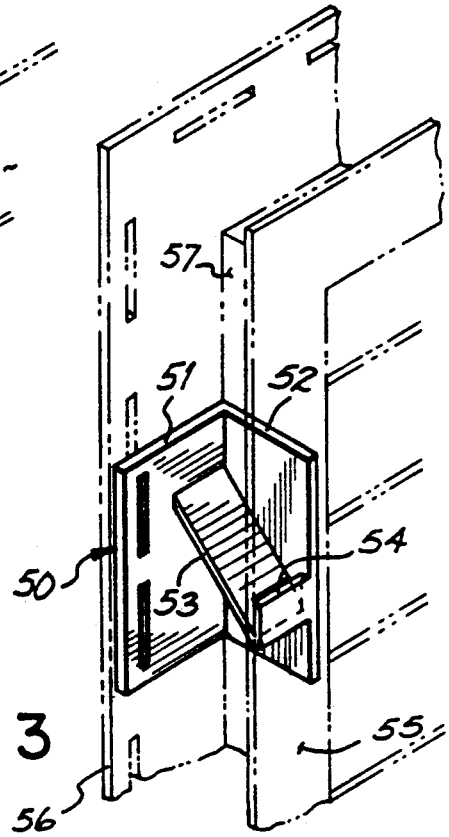
FIG. 3 is a perspective view similar to FIG. 2 of an alternate embodiment of the present invention.

FIG. 3 shows an alternate embodiment of the present invention. A tab 50 is formed as a small separate piece (referred to as a flashing tab) having a small nail strip 51, a small abutment strip 52 and a tab 53 running from the nail strip 51 along the abutment strip 52. A small lip 54 extends vertically up from tab 53 opposite nail strip 55.

Flashing tab 50 can be used in combination with an existing channel strip 55 by simply nailing flashing tab 50 in a channel 55 as the channel is nailed to a wall. A plurality of these flashing tabs 50 would be placed along the channel as desired. Alternately, flashing tab 50 can be adhesively bonded to the nail strip 56 and abutment strip 57 of channel 55.

Again, these tab pieces 55 have the same benefit of the primary embodiment of the present invention. Water flowing down the channel will run along tab 53 and is directed out of the channel by vertical lip 54. In FIG. 3, the flashing tab for the left channel is shown. A mirror image tab would be provided for the right channel (not shown).

The channel 10 of the present invention is formed by simply injection molding the channel with the tab as part of the vent, fixture, or frame piece. The present invention has, of course, utility in an elongated channel which surrounds a door or a window in a house, such as that shown in U.S. Pat. No. 4,228,630. Further, the present invention can be employed in the channel of a mounting block for a light fixture such as the type disclosed in U.S. Pat. No. 4,726,152. Further, it can be incorporated into a siding channel used on exterior corners of buildings. A corner channel, as shown as 20 in FIG. 1, has two channels which share the same abutment strip, but have separate opposed nailing strips and cover strips. Tabs can be positioned in both channels of the corner channel providing the same benefits of the present invention.

Also, this can be used in embodiments which do not include a cover strip. In certain vents, the cover strip is separate from the abutment strip and snaps in place. In such embodiments, the tab would be fixed only to the nailing strip and the abutment strip and may include a vertical lip such as lip 54 on tab 50.

Thus, the present invention provides advantages for any abutment channel used for lapped siding. In all of these embodiments, the channel will act to direct water flowing in the channel, away from the house to the exterior side of the siding so that it can flow down the siding and away from the house. This will protect the interior surface of the house along with the siding itself.

This has been a description of the present invention along with the preferred methods of practicing the present invention currently known to the inventor.

However, the invention itself should be defined only by the appended claims wherein I claim:

1. An abutment channel for lapped siding comprising:

a first narrow planar strip, said first strip adapted to be nailed to the side of a building with a first side of said strip against said building;

a second narrow planar strip extending from an edge of said first strip whereby second said strip acts as an abutment for siding nailed to said building;

a rectangular tab having a first edge bonded to a second side of said first strip and a second adjacent edge bonded to a side of said second strip;

said tab extending at an angle away from said first strip towards an outer edge of said second strip.

2. The abutment channel for lapped siding claimed in claim 1 further comprising a cover strip extending from said second strip parallel to said first strip.

3. The abutment channel for lapped siding claimed in claim 2 wherein said tab extends at an angle of from about 20° to about 70° from said first strip.

4. The abutment channel for lapped siding claimed in claim 3 wherein said angle is about 45°.

5. The abutment channel claimed in claim 2 wherein said channel is a door frame channel.

6. The abutment channel claimed in claim 2 wherein said channel is a window frame channel.

7. The abutment channel claimed in claim 2 wherein said channel is a corner channel.

8. An abutment channel for lapped siding claimed in claim 1 further comprising a third strip extending at about a 90° angle from said second strip wherein said tab extends to an inner side of said third strip.

9. The abutment channel claimed in claim 8 comprising a plurality of tabs spaced along said channel.

10. The abutment channel claimed in claim 8 wherein said channel is an integral part of a vent.

11. The abutment channel claimed in claim 8 wherein said channel is an integral part of a mounting for an electrical fixture.

12. The abutment channel claimed in claim 1 further comprising a lip upwardly extended from said tab opposite said first strip.

13. A building having an exterior wall, having a channel and siding nailed against said outer wall with an edge of said siding extending into said channel;

said channel including a first elongated narrow planar strip nailed to the side of said building;

a second elongated narrow planar strip extending from an edge of said first strip whereby said second strip acts as an abutment for said siding nailed to said building;

a third strip extending from said second strip;

a rectangular tab having a first edge bonded to a second side of said first strip and a second adjacent edge bonded to a side of said second strip with a third edge opposite said first edge bonded to an inside surface of said third strip;

a section of said siding intersecting said tab, said siding having a slit permitting an edge of said siding to intersect said tab whereby water flowing down said channel is directed away from said building by said tab to an exterior side of said siding.

* * * * *